United States Patent [19]

Eckhardt

[11] 4,114,356

[45] Sep. 19, 1978

[54] OPEN-END SPINNING APPARATUS

[75] Inventor: Friedrich Eckhardt, Salach, Fed. Rep. of, Germany

[73] Assignee: Zinser Textilmaschinen GmbH, Ebersbach, Fed. Rep. of Germany

[21] Appl. No.: 711,721

[22] Filed: Aug. 5, 1976

[51] Int. Cl.[2] ..... D01H 15/00; D01H 1/12

[52] U.S. Cl. ..... 57/34 R; 57/58.89; 57/81

[58] Field of Search ..... 57/34 R, 34 B, 58.89, 57/80–81

[56] References Cited

U.S. PATENT DOCUMENTS

| | | | |
|---|---|---|---|
| 1,481,982 | 1/1924 | Brace et al. | 57/81 |
| 2,611,230 | 9/1952 | Saunders et al. | 57/81 X |
| 3,854,274 | 12/1974 | Bartling | 57/34 R |
| 3,938,306 | 2/1976 | Bous | 57/34 R |
| 3,944,166 | 3/1976 | Hermanns | 57/34 B X |
| 3,962,855 | 6/1976 | Stablecker | 57/34 R |
| 3,999,362 | 12/1976 | Schulz et al. | 57/34 R |

*Primary Examiner*—Charles Gorenstein
*Attorney, Agent, or Firm*—Edwin E. Greigg

[57] ABSTRACT

An open end spinning machine is provided with individual thread guides for each station. The thread guides direct compressed air along an axial channel in which the thread travels. The air expels the thread in the direction reverse to normal thread travel whenever it is desired to return a broken thread to the spinning chamber and rotor. The apparatus includes a thread cutting mechanism, disposed between the pneumatic thread guide and the spinning chamber, for cutting the thread to a fixed length so that it may be reattached to the fibers in the rotor without discontinuities.

3 Claims, 2 Drawing Figures

OPEN-END SPINNING APPARATUS

BACKGROUND OF THE INVENTION

The invention relates to an open-end spinning machine including a spinning rotor and a pair of draw-off rollers, equipped with a thread tube adjacent the spinning chamber. The thread tube is constructed as an ejector nozzle which is capable of transporting the end of the thread back into the opening of the spinning chamber for reattachment to the fibers located therein.

In open-end spinning machines, a thread breakage is repaired by transporting the end of the thread into the fiber collection groove of the spinning rotor in the spinning chamber so that the end of the thread reattaches to the fibers located in the collection groove and the new thread is then pulled out of the spinning rotor. Whenever the spinning machine is stopped, thread breakage takes place, so that, when an open-end spinning machine is restarted, all the broken threads at a, sometimes, large number of individual spinning stations within the machine must be repaired prior to start-up. Until the present time, a requirement for automatic thread reattachment was that the end of the thread to be reattached had to be within the suction region of the spinning chamber and, more particularly, in the thread draw-off channel of the spinning chamber, at the time when spinning is resumed. It had been proposed to fulfill this condition by providing that the draw-off mechanism for the thread is arrested so rapidly when a thread breakage occurs during normal spinning that the end of the thread will still be within the effective suction region of the spinning chamber which includes the spinning rotor. However, the customary high thread delivery speeds make such a condition very difficult to fulfill because they require very rapidly-acting sensors, clutches and brakes for arresting the rotating spools and rollers and thus can be met only with very considerable technical expense. The thread breakages which occur naturally when the spinning machine is stopped make it possible to reduce the speed slowly, so that it is not difficult to have the ends of the threads remain within the suction region of the spinning chamber but, when the chamber is opened for cleaning of the rotor or for any other reason, the ends of the threads still generally slide out of the thread draw-off channel and thus prevent an automatic reattachment.

For this reason, it has been proposed in Czech Pat. No. 120,497 to provide a movable tube having an ejector nozzle located between a pair of draw-off rollers and a wind-up mechanism of the spinning machine. However, this mechanism is complicated and still does not guarantee the certain repair of the thread breakage. Furthermore, even if the thread repair is successful, there is the possibility of an undesirable change in the local thickness of the thread or excessive twisting thereof.

OBJECT AND SUMMARY OF THE INVENTION

It is a principal object of the invention to provide an open-end spinning machine of the general type described above in which automatic thread attachment is more likely to succeed than in previously known apparatus. The apparatus according to the invention attains this object by providing, among other things, a thread-severing mechanism in association with a thread ejector nozzle.

By cutting off the broken threads, the end of the thread is placed in a predetermined relative position with respect to the ejector nozzle and with respect to the thread exit orifice from the spinning chamber so that the ejector nozzle is capable of blowing this new thread end into the suction region of the spinning chamber while the thread is beinng transported in the reverse direction by the pair of draw-off rollers or in some other way.

For this reason, it is no longer necessary for the ejector nozzle to be movable in the direction of the thread exit orifice of the spinning chamber but, on the contrary, it may be locally fixed and may be attached, for example, to the machine frame or to the spinning chamber itself. If the spinning chamber is movable, for example to permit lifting the rotor shaft from the device belt, as is customary in some open-end spinning machines, then it is suitable to mount the ejector nozzle fixedly on the spinning chamber and thereby maintain its relative position in the spinning chamber constant. In other cases, the ejector nozzle could be attached to the machine frame, in which case its relative position with respect to the draw-off rollers would remain constant.

The apparatus according to the invention is simple in construction and reliable in operation and has many other advantages. The novel construction of the spinning stations according to the present invention permits a particularly simple and reliable simultaneous automatic reattachment of all the threads when the machine has been stopped. It is also possible to provide that, during the normal operation, any thread breakage occurring at a single open-end spinning location can be rapidly and automatically relieved without interrupting the spinning operation at the other locations. This may be done by providing that the processes intended to repair the thread breakage take place independently at each location. Thus the apparatus according to the invention is usable for thread repair independently of its cause and also permits constructional simplifications in the control method and the other details of the spinning location or the spinning machine which uses them.

Since the relative distance of the end of the thread obtained by the thread cutter according to the invention with respect to the fiber collection groove of the rotor is exactly known, the cut thread may be transported backwardly by a predetermined distance which is such that the end of the thread precisely locates with respect to the fibers in the fiber collection groove of the rotor so as to obtain an optimum thread repair which does not introduce any changes in the thickness of the thread produced or any excessive twisting.

It is particularly advantageous if the severing motion of the cutter in the thread cutting mechanism extends over the air outlet orifice of the ejector nozzle. In this manner, the position of the severed thread is particularly favorable because its free end is in an optimum location within the thread channel of the ejector nozzle without extending therefrom and thus is not exposed to the hazard of any displacement which might change the predetermined length and would jeopardize the success of the reattachment process.

It may be preferably provided that the opening of the thread channel in the ejector nozzle remote from the spinning rotor is flared so as to permit engaging a thread end even after it has traversed the thread channel in the ejector nozzle in the direction of the draw-off rollers.

It is also advantageous if the ejector nozzle is embodied as an annular nozzle. Such an embodiment is especially favorable if the mechanism is intended to repair thread breakages occurring from a machine shut-off. For, in that case, all of the ejector nozzles on the machine will be used simultaneously and will therefore require a substantial amount of air flow. Inasmuch as annular nozzles are more efficient than nozzles having a unilateral air supply, the total required air flow is thereby reduced.

The invention will be better understood as well as further objects and advantages thereof become more apparent from the ensuing detailed specification of two preferred embodiments taken in conjunction with the drawing.

DESCRIPTION OF THE PREFERRED EMBODIMENTS

Figures 1, 2:
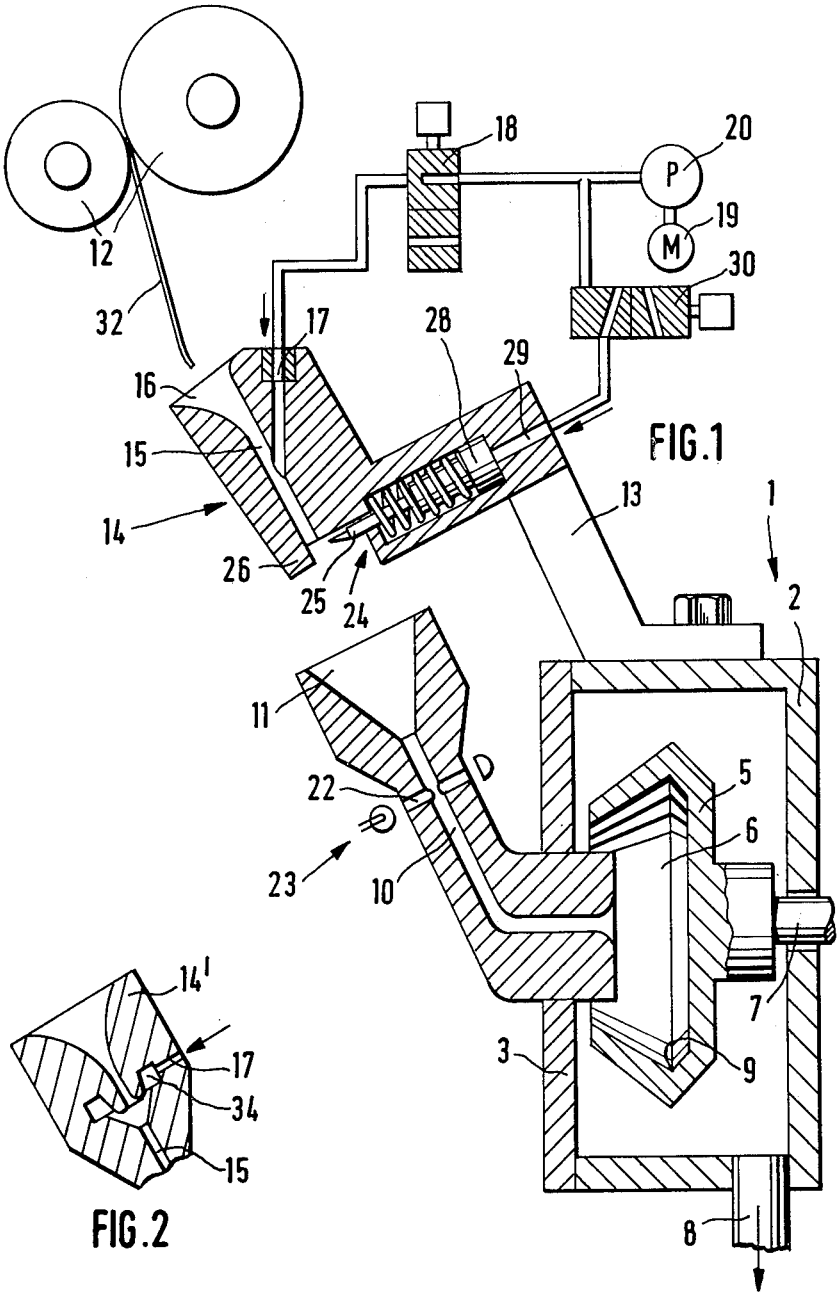
FIG. 1 is a partial, sectional, longitudinal cross section through an open-end spinning mechanism including an apparatus for reversing the thread into the spinning chamber.
FIG. 2 illustrates a second embodiment of the ejector nozzle for transporting the thread back into the spinning chamber.

Turning now to FIG. 1, there is shown a single spinning chamber 1 of an open-end spinning machine which may include a multitude of such spinning chambers. The spinning chamber 1 includes a housing 2 with a removable cover 3. In known manner, not further illustrated, the spinning chamber includes a resolver and supply device which supplies fibers removed from the roving to the spinning rotor 5 in which they are collected by centrifugal force in a collection groove 9 and are pulled off as threads 32 while the spinning rotor rotates. The spinning rotor 5 is driven by a motor, not shown, via a drive shaft 7. A source of vacuum of known type, not shown, constantly aspirates air from the interior 6 of the spinning rotor 5 through the tube 8. Thus, air is constantly aspirated into the thread exit orifice 11 and flows into the interior 6 of the rotor through the thread draw-off channel 10. The channel 10 is formed by a thread draw-off tube fixedly attached to the cover 3 and being part of the spining chamber 1.

During the spinning process, the spun thread is pulled out through the thread channel 10 and the flared opening 11 by a pair of draw-off rollers 12. A tranverse bore 22 in the draw-off tube permits monitoring the presence of a thread in the channel 10 by means of a light sensor 23. Located in the space between the draw-off roller pair 12 and the thread exit orifice 11 of the thread channel 10 is a tube embodied as an ejector nozzle 14 and attached to the housing 2 of the spinning chamber 1 by means of an arm 13. The ejector nozzle 14 has an axial bore 15 which is flared at the side facing the pair of rollers 12. Disposed obliquely with respect to the long axis of the bore 15 is an injection bore 17 which terminates in the bore 15 just below the flared opening 16. A valve 18 permits the admission of compessed air through the bore 17 from a source of air including, substantially, a motor 19 and a pump 20. The ejector nozzle 14 is so located above the thread draw-off channel 10 that its bore passage 15 is aligned with the thread exit orifice 11 and that the air which it expels in normal operation is capable of transporting a thread 32 in the opposite direction of its travel during normal operation of the machine.

Disposed at the end of the ejector nozzle 14 nearest the opening 11 is a thread-severing device 24 which includes a movable cutter 25 and an anvil 26. The cutter 25 is actuated by a piston 28 moving in a cylinder which is provided with compressed air from the air source 19, 20 through a line 29 including a valve 30.

When an open-end spinning machine is stopped, a thread breakage occurs at every one of the individual open-end spinning locations. In order to repair these breakages, the torn ends of the thread must be returned to the interiors of the spinning rotors 5. This may be performed in the following manner. The run-down of the spinning machine to the stopped condition is so controlled that the ends of the threads which are traveling toward the draw-off rollers 12 have not yet reached them when the machine is at a standstill. Rather, each of the threads is located in some, relatively undefined, location between the thread exit orifice 11 and the draw-off rollers 12. In order to prepare the open-end spinning machine for a restarting, the first operation performed is to actuate the vacuum supply of all of the locations through the various tubes 8 and to cause the introduction of compressed air into the bore 17 by actuation of the valves 18. Subsequently, the draw-off rollers 12 are rotated in the reverse direction with respect to normal operation by reversing transmissions or clutches or the like, not shown. Thus, the returned ends of the threads are blown by the ejector nozzles 14 into the thread orifices 11 of the thread draw-off channels 10 and are subject to the prevailing vacuum which pulls them further into the interiors of the spinning chamber. The draw-off rollers 12 are reversed at least far enough so that the ends of the threads 32 at all of the spinning locations are definitely located between the thread severing device 24 and the thread orifices 11. It is advantageous to return the threads even further, so that, when the machine is stopped, any defective pieces of thread near the end which are due to irregular run-down of various machine parts still pass the thread severing mechanism 24. At that time, the draw-off rollers 12 are stopped everywhere and the valves 30 are actuated, thereby causing the thread severing devices 24 to operate. The cutters 25 impinge on their respective anvils 26 and sever the threads 32. The bits of thread cut from each thread are aspirated through the channels 10 and are removed pneumatically.

In order to restart the open-end spinning machine, the draw-off rollers 12 at each location are again moved backwardly so that the reversed threads can be blasted by the ejector nozzles 14 back into the thread exit orifices 11. The draw-off rollers 12 at every location are reversed by the exact amount necessary that the ends of the threads at all locations extend exactly to the fiber collection grooves 9 of the spinning rotors 5 where they combine with the fibers located there and thus repair the thread breakage. At this time, the draw-off rollers 12 may be switched back to normal, forward operation and the ejector nozzles 14 are deactivated by operating the valves 18. The preparation of the machine for restarting and the restarting itself may follow one another without delay. However, it is possible to prepare the machine after a shut-down and to permit it to remain in that condition for an extended period of time although the vacuum and the ejector nozzles 14 would then be made inoperative and only activated again when the machine is to be restarted.

The method for thread repair at an individual spinning station after a thread breakage proceeds in the same manner, although the whole machine would remain operational and the light sensor 23 would sense the breakage and thus initiate only those processes required for repairing the thread breakage at that particular location. It is particularly suitable if, in that event, the thread 32 is transported by a device such as described in the German Offenlegungsschrift No. 20 39 473, especially as illustrated in FIG. 2 therein.

Instead of fastening the ejector nozzle 14 to the spinning chamber 1 as shown, it may also be fastened to the machine frame, which is particularly suitable if the spinning chamber 1 is itself movable within limits.

It will be understood that any other sensor operating under a different principle may be used instead of the light sensor 23 for monitoring the presence of a thread and such a sensor could preferably be a thread tension sensor located between the roller 12 and the ejector nozzle 14.

FIG. 2 illustrates an embodiment of the invention in which the ejector nozzle 14 is an annular nozzle 14' in which the access bore 17 terminates in an annular channel 34 which is continued conically into the bore 15.

The foregoing represents preferred embodiments of the invention, it being understood that many variants thereof are possible within the spirit and scope of the invention, the latter being defined by the appended claims.

What is claimed is:

1. In an open-end spinning machine which includes at least one spinning chamber and rotatably mounted therein a spinning rotor, means for producing suction in said chamber, apertured means for receiving a thread in said chamber and transport means for transporting a thread to and from said spinning chamber, the improvement comprising:

thread guide means with an exit orifice for compressed air and having a terminus and a first bore, the axis of said first bore being directed to a draw-off channel in said apertured means; and an injection aperture comprising a second bore arranged to obliquely intersect said first named bore and thread cutting means supported relative to said first bore, said cutting means being movable to intersect said thread as it is emitted from said exit orifice.

2. The combination as defined by claim 1 in which said cutting means moves perpendicular to the path of said thread.

3. An open-end spinning machine as defined by claim 1, wherein said thread guide means as an exit orifice for compressed air and wherein said cutting means moves perpendicular to a path of said thread as it is emitted from said exit orifice.

* * * * *